United States Patent [19]

Crooks

[11] Patent Number: 4,461,377

[45] Date of Patent: Jul. 24, 1984

[54] COIN OPERATED VENDING STACK

[76] Inventor: Randall D. Crooks, 460E, 300 North American Fork, Utah 84003

[21] Appl. No.: 446,247

[22] Filed: Jan. 26, 1983

[51] Int. Cl.[3] ..... G07F 11/04

[52] U.S. Cl. ..... 194/78; 221/125

[58] Field of Search ..... 194/2, DIG. 19, 57, 194/58, 78; 221/125

[56] References Cited

U.S. PATENT DOCUMENTS

| | | | |
|---|---|---|---|
| 458,226 | 12/1936 | Brus | 194/DIG. 19 |
| 640,963 | 1/1900 | Sibley . | |
| 809,563 | 1/1906 | Hansen . | |
| 2,960,374 | 11/1960 | Kozelka . | |
| 3,076,537 | 2/1963 | Hirschson . | |

*Primary Examiner*—Stanley H. Tollberg
*Attorney, Agent, or Firm*—Gordon K. Anderson

[57] ABSTRACT

A multi-compartment vending stack body (20) has sides engaging a series of roller assemblies (32) within a dovetail slot allowing movement in a vertical direction. A number of doors (42) are arranged in columns, each door having a spreader (46) rotatably attached and an integral tapered appendage penetrating the rollers upon pivotal rotation of the door. A coin carriage at the bottom of the stack allows the rollers (34) to drop freely a given distance, at least sufficient to allow penetration of only one spreader (46) when a proper combination of coins are introduced. The coin carriage employs a plunger block (62) and a pair of forks (66) to retain a number of spring loaded coin holders (64) each with a radiused cavity the appropriate size of the denomination. When manually urged into the body, the coin depresses the holder (64) and a forked end precisely enters a receiver block (70) allowing a slack eliminator (48) with a tapered flange to be slid away from the roller stack (32) permitting the stack to be penetrated by the spreader (46). A catch (52) holds the slack eliminator (48) away until the door is opened when the pressure of the rollers (34) depresses the catch (52) allowing the spring loaded eliminator (48) to return directly under the rollers (34) impeding further movement.

7 Claims, 11 Drawing Figures

COIN OPERATED VENDING STACK

TECHNICAL FIELD

This invention relates in general to check controlled apparatus with lock release forwarding timing for article delivery with door and lid lock and more specifically to a coin compression actuated modular vending stack.

BACKGROUND ART

Previously, coil operated vending machines have utilized mechanical methods as employed by metallic structure to both receive the coin, verify its size, and actuate the mechanism to release the product, or at least provide access through doors in compartments. Hirchson in U.S. Pat. No. 3,076,537 teaches such a device. This apparatus utilizes castings that provide a working surface that arcuates, disengaging a guiding surface displacing a series of blocking elements when the coin is inserted. Further, fixed adjacent rows of goods compartments are actuated individually with a single coin release through a channel. A coin entering the channel falls by gravity onto a pin tilting lever mechanism freeing the blocking elements, or if the coin is not the proper size, it proceeds into a return chute. Manipulation of a lever is also required to return the coin if not accepted. U.S. Pat. No. 2,960,574 issued to Kozelka provides a heated cabinet with spring loaded multiple doors. Guide rods with a plurality of slideable pins assist the downward sliding of a vertical bar one stage at a time, disengaging the next lower door when a coin is inserted into the release mechanism.

Hansen in U.S. Pat. No. 809,563 utilizes a longitudinal rack bar with spaced guiding devices. The coin rests between an arm and a lug allowing the linear action of the rack to delivery plates. The rack bar contains teeth locking the rearward movement with a pinion gear dispensing one article from a reservoir at a time. U.S. Pat. No. 640,963 issued to Sibley teaches a pawl on an oscillating spring loaded arm with a projecting finger engaging the coin for operation by grasping the product and sliding it forward from the apparatus with an operating arm.

The last two references are basically for background purposes and are indicative of the art to which the invention relates.

DISCLOSURE OF THE INVENTION

In order to prevent theft and provide mechanical protection to unattended vending equipment, considerable effort has previously been given to strength and integrity of the structure itself. In most cases the material for accepting the coin has been metal, usually die cast or in some instances stamped, or a combination thereof. Due to its expense, some devices have bypassed the problem by using chutes to drop a coin through, however, more intricate and precise mechanisms are required to accommodate this approach. As economics dictate a less expensive material, the instant invention fills that need and, therefore, becomes the primary object to provide an apparatus using a structural thermoplastic material that will withstand the abuse of the application, while decreasing the tooling expense. In order to integrate plastics into the coin mechanism, it is necessary to use an alignment principle wherein the coin itself becomes the structure to effectively align the spike of the holder through an opening in a receiver block. As thermoplastic material is more cost effective and tooling expenditures are considerably less than die cast metallic parts, this object and advantage may be easily realized.

An important object incorporates the use of the modular approach with the stacks completely removable and interchangeable allowing the stacks to be transferred as a unit into another cabinet. This also provides flexability of size of the cabinet, accepting single or multiple stacks equally well, fulfilling the size requirement of the application, also allowing wall or floor mounted cabinets to be utilized in modular form.

Another object allows the coin holder to be easily and quickly changed to another denomination or combination thereof. As economic changes effect the price of goods, this feature by itself is a unique improvement. The changeover is accomplished by simply substituting only a single coin holder, as all ancillary elements are compatible in configuration.

Still another object provides a positive coin rejection if the coin is not the proper diameter and thickness, penetration into the coin holder is not possible. Since the coin did not enter the device, it may be easily removed while still under control of the operator. A coin return apparatus with its necessary levers, handles, chutes, etc., therefore, is unnecessary.

Yet another object provides flexibility to place a larger product in each compartment by removing a partition therebetween, doubling the size of the area while still allowing the product to be removed through the single door at the front of the enclosure.

A further object allows the use of a simple stack of rollers and a knife edged spreader, to allow only one door to open at a time. Prior art, in many cases, uses chains for this purpose, which is basically more expensive and requires complex individual mechanisms for each door.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
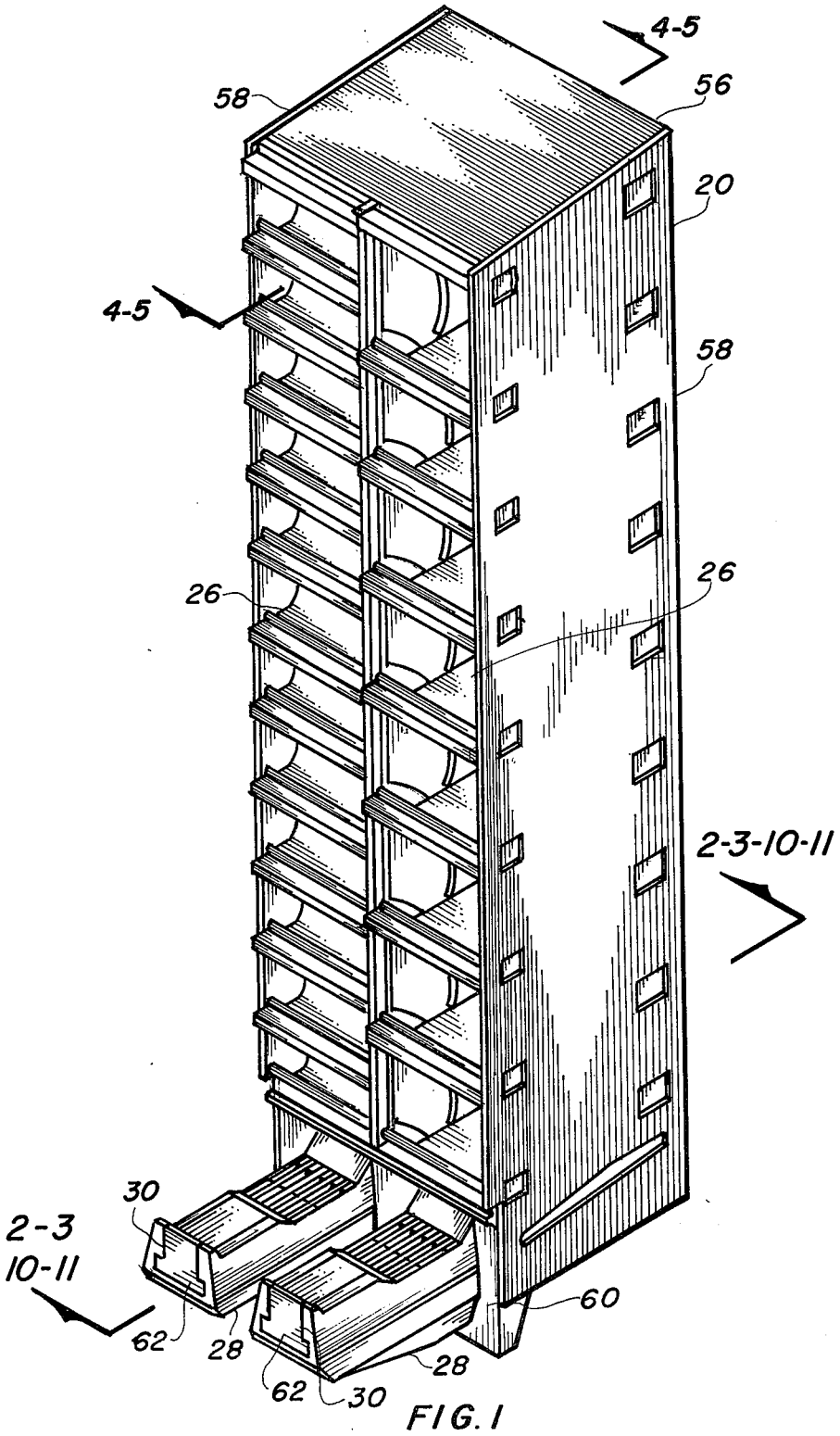
FIG. 1 is a partial isometric view of the preferred embodiment with all of the doors closed and the coin carriage in its extended position.
Figure 2:
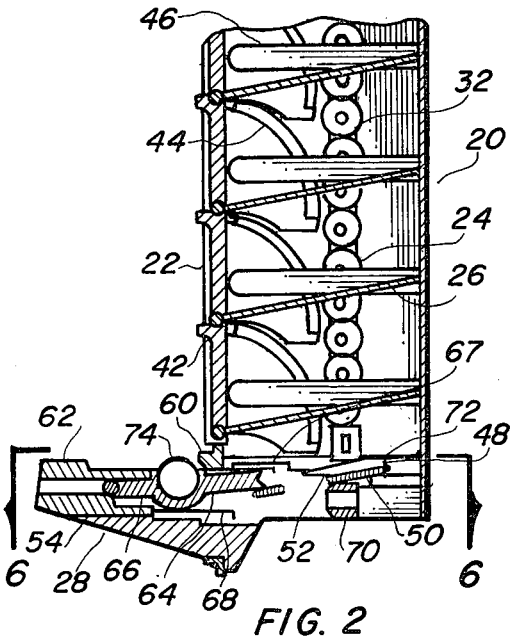
FIG. 2 is a partial sectional view taken along lines 2—2 of FIG. 1 with the carriage extended and a coin in the slot.
Figure 3:
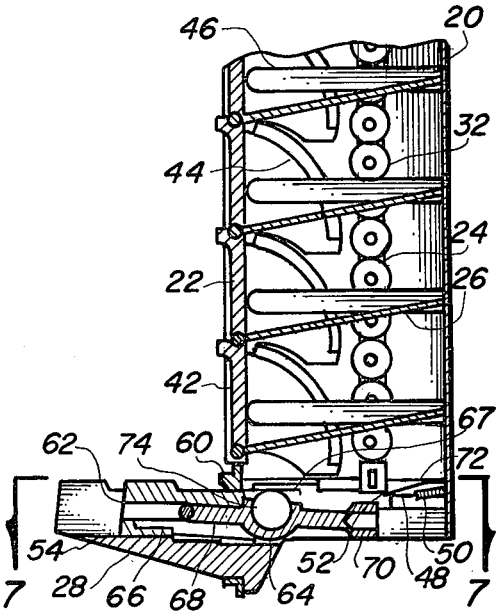
FIG. 3 is a partial sectional view taken along lines 3—3 of FIG. 1 with the carriage retracted depicting the roller pile distended and the slack eliminator moved from preloading the pile.
Figure 4:
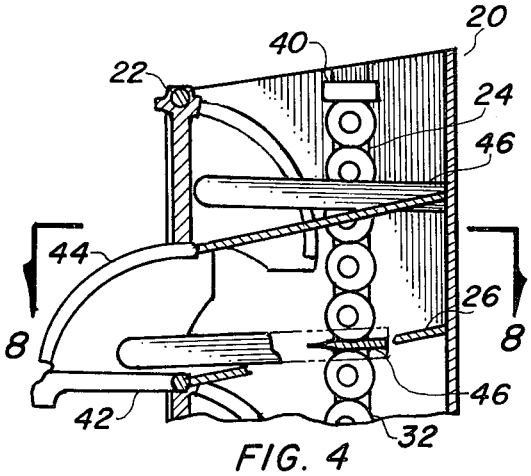
FIG. 4 is a partial sectional view taken along lines 4—4 of FIG. 1 with a door opened and the spreader penetrating the pile.
Figure 5:
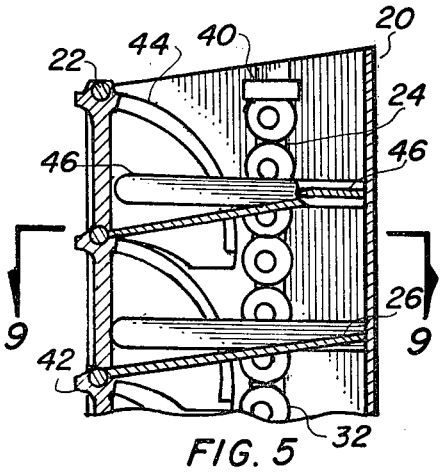
FIG. 5 is a partial sectional view taken along lines 5—5 of FIG. 1 with the doors closed.
Figure 6:
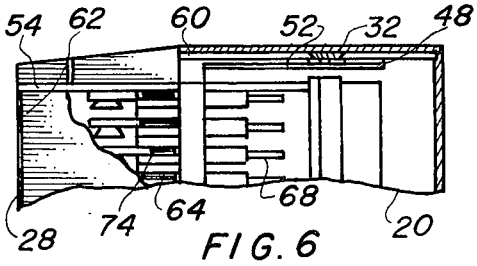
FIG. 6 is a partial sectional view taken along lines 6—6 of FIG. 2 with the carriage extended and the coin in the slot.
Figure 7:
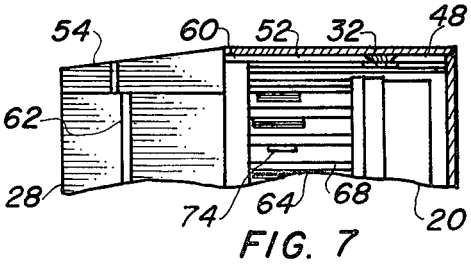
FIG. 7 is a partial sectional view taken along lines 7—7 of FIG. 3 with the carriage retracted depicting the roller pile distended and the slack eliminator moved from preloading the pile.
Figure 8:
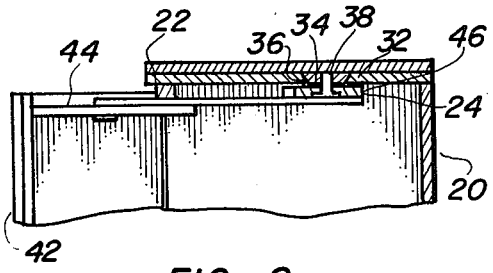
FIG. 8 is a partial sectional view taken along lines 8—8 of FIG. 4 with the door opened and the spreader penetrating the pile.
Figure 9:
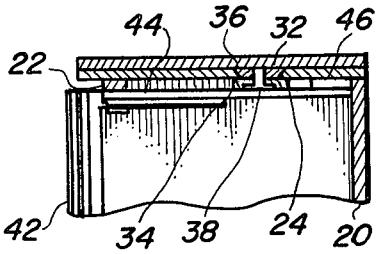
FIG. 9 is a partial sectional view taken along lines 9—9 of FIG. 5 with the doors closed.

Referring now more specifically to the referenced characters of the drawings, the invention in the preferred embodiment utilizes a stack body 20 injection molded of thermoplastic in U-shape with a plurality of recesses, grooves and notches 22 to provide means for attaching a plurality of doors stacked one on top of the other. Further, the shape provides a recessed dovetailed roller groove 24 in one side of each column the entire height of the stack. Individual compartments are defined by a divider 26 in the form of a flat shelf sloping to the front, contiguous with both sides and juxtapositioned equally throughout the height of the body 20. At the bottom of the stack a housing 28 is projected to the front and contains opposed grooves 30 for containment of a coin operating mechanism. The body 20 may be of any thermoplastic material with sufficient structural integrity for the application, such as styrenes, polypropylenes, polycarbonates, acrylics, polyethylenes, phenolics, or the like. A roller pile 32 is inserted into the groove 24 consisting of a plurality of circular rollers 34 in disc-shape, having a hole in the middle, mating rectangular roller carriages 36 having opposed beveled sides with a similar bore in the middle and a round flanged tubular axle 38 rotatably inserted into each corresponding opening. The axle 38 is somewhat smaller in diameter than the hole, allowing free rotation of the roller 34 while held in place with a flange on one end and pressed into the carriage 36 on the other. The assemblies are retained within the frame by placing the carriage into an open slot at the top of the dovetailed groove and slipped downward on top of each other until the stack is completely superposed. A pile retainer 40 is inserted into the slot on top of the pile retaining assemblies within the frame. The pile 32 is free to move up when spread apart a predetermined distance by controlling the number of assemblies and configuration of the retainer 40. The inside surface of the dovetail groove 24 and beveled sides of the carriages 36 slideably interface preventing horizontal movement of the assembly while still allowing freedom of rotation of the rollers 34. Each column within the body 20 contains one such roller pile 32.

A door 42 is rotatably positioned with the body 20 forward of each compartment contiguous with the shelf 26. The door 42 has a circular extended appendage on each horizontal bottom edge that rotatably mates with a pair of sockets 22 in the body 20. Each door contains a flange 44 at right angles to the front surface. The flange 44 is offset from the side of the body 20 and contains a hole somewhat off-center of the axis. A spreader 46 is positioned between the body 20 and the flange 44 and is slideably retained between these two surfaces. One end of the spreader 46 has an integral tapered raised projection in the center parallel to the longitudinal edge in knife edge fashion, the width equalling the predetermined distance of the roller pile 32. The other end of the spreader 46 contains a raised circular projection rotatably inserted into the forementioned hole in the door flange 44. The configuration allows the spreader 46 to be held in place between the body 20 and door flange 44 horizontally with one end retained by the hole in the flange 44 and axial movement is limited by the tapered knife edge embracing a pair of rollers in the pile 32. When the stack is relaxed a predetermined distance, a single door 42 may be opened by axial downward rotation away from the body 20 linearly moving the spreader knife edge forward toward the door separating a pair of rollers 34. This action takes up all of the slack in the pile confining the operation to a sole door at any given time.

A slack eliminator 48 is positioned under the roller pile 32 with a tapered surface on the top vertical edge. The bottom edge is flat and a rectangular projection for a stop, is on one side and a round stem is protruding on the opposite side for spring attachment. The eliminator 48 slides freely horizontally, as confined within grooves in the body 20 and is attached with a compression spring 50 to maintain its position directly under the pile 32. The tapered surface maximum height is compatible with the predetermined distance providing a tight fit between the pile 32 and body 20 when urged forward by the spring 50 taking up the slack. The position for this member before actuation by the coin mechanism is at its maximum height which by its portion locks all of the doors closed and provides integrity of the attitude.

A catch is in the form of a rectangular member with a notch on one end and an opposed round stem and a circular extended appendage on the other. The catch is also held in slideable confinement with grooves in the body 20 and is in direct alignment with the slack eliminator 48. The compression spring 50 is attached onto the round stem and maintains attraction of the catch 52 to the eliminator 48. When the coin mechanism is actuated and thrust into the stack, the catch 52, being contiguous thereto, interfaces with the eliminator 48 at the end with the notch pushing the tapered surface rearward away from the pile 32. Spring tension holds the combination together until a door 42 is opened, at which time the pile 32 is forced downward by the introduction of the spreader 46 between the rollers 34 forcing the notch of the catch 52 below the eliminator knife edge 48. This function resets the apparatus, as the door opening simultaneously provides a locking action, as the spring 50 pulls the eliminator 48 back into place under the pile 32 upon completion of the operation.

The body 20 consists of a basic frame 56 and a pair of sides 58 connected to enclose the compartments and a stack adapter 60 is positioned directly beneath the doors 42 and within the front projection 28. This adapter 60 consists of a rectangular frame with an open center inwardly tapered from the top front.

The coin mechanism may be of any type suitable for the application, however, the preferred embodiment utilizes a coil carriage integral with the frame 56 and slideably affixed therein. Each carriage is comprised of a bifurcated plunger block 62 that contains a series of cavities and internal teeth in the fork end. The block 62 is elongated on the sides to interface with a groove in the body. The outside surface is knurled, providing a no-slip surface for manual manipulation. Each cavity is rectangular in shape and is in the end opposite the forks. A recessed radial socket is also formed at the beginning of each cavity and is parallel with one of the sides.

A plurality of coin holders 64 are positioned within the confines of the plunger block cavities. Each holder 64 has a raised projection on one end and a V-shaped notch on the other with a two sided radiused slot in the middle. The slot is the exact diameter with the depth corresponding exactly to the size of a coin. As a plurality of holders are used in each stack, the combination may be varied to result in the proper denomination for each combination. The holders 64 are also independantly interchangeable and are easily removed and replaced changing the physical arrangement and thus the item cost. Each holder 64 is positioned within the cavity of the plunger block 62 with the raised projection on one end of the holder 64 interfaced rotatably with the radial socket of the block 62. This allows the projecting end to move freely in a vertical plane.

A lower resilient compression fork 66 having a series of tines on one end and a flange on the other is nested into the stack body housing 28. The flange is at right angles to the tines and is compressingly urged into a groove in the housing 28 for maintaining its orientation. Each tine is positioned directly beneath an individual coin holder 64 and functions as a leaf spring being compressed downward when the coin holder is depressed as it moves into the body 20. Tension is continually applied to the holder 64 as long as it is located within the body and returns to its relaxed horizontal position when retracted. The deflection of the tine is dependant upon a coin inserted within the holder, as the coin edge creates the axial force. An upper compression fork 67 of similar configuration to the lower fork 66 is retained between the body 20, stack adapter 60 and the projecting ends of the coin holder 64. Each tine of the fork is positioned directly above an individual coin holder 64 and similarly functions as a leaf spring maintaining downward pressure on the coin 74. Pressure is sustained while slideably positioning the holder to the end of the stroke where the coin is released.

A plunger fork 68 is comprised of a plurality of flat rectangular fingers with parallel spaces between. The number of spaces and configuration relate directly to the coin holders 64, as the space is smaller than the width of the holder 64 allowing movement therebetween. The plunger fork 68 is also retained within the body 20 and is in direct alignment with the coin holders 64 providing linear containment and coin enclosure. The coin radiused slot within the coin holder is three-sided with the plunger fork flat fingers 68 supplying the other side, creating a complete cavity with two parallel sides and a radiused bottom to receive a coin therein. The clearance between the two elements is critical, as the holder 64 must be slideable within the space and yet the cavity must be the actual width of the coin certifying its authenticity.

A receiver block 70 is positioned within the body 20 directly beneath the compartment column and is in L-shape. The block has a plurality of slots of a size and orientation to receive the forked end of each coin holder 64, allowing free passage therethrough when precisely aligned and positioned. The block 70 further contains an angular face on the top and bottom of the slot and is so configured as to depend away from the acuminated surface. As the holder 64 forked end must pass through the slot the alignment, if incorrect by virtue of the coin size, allows the sharp corner of the block 70 to engage the V-shaped notch on the end of the holder 64 directing it away from the slot. This impedes its rearward travel until either the coin binds on the adapter 60, or the notch contacts the edge of the block 70. A pair of pawls 72 interface with the internal teeth of the plunger block 62 necessitating full travel of the plunger block 62 before a door 42 may be opened eliminating the possibility of reset without complete door opening. When the coin holders 64 pass through the coin adapter 60, the coins fall from the holder and are collected in a tray, not shown, underneath the stack that is part of the cabinet in which the stack is installed. As previously described, the apparatus is actuated to allow a single door to open and is reset by that action. If the coin is too large, it will not enter the holder or the plunger block 62 will not move forward and pass the coin beyond the adapter 60. A coin too small will not allow the holder 64 to be lowered sufficiently for the forked end to pass through the receiver block 70, thwarting the rearward movement.

The material for all of the components may be the same as the body 20 in any combination thereof, or metallic substances may be utilized with equal ease. The preferred thermoplastics are selected for their properties of compressibility and shear strength and ease of manufacture. The stack assembly may be in any combination of widths, such as dual, shown in FIG. 1, triple or any convenient number, and the height may vary with any number of compartments suitable for the application. The preferred embodiment, as depicted in FIG. 1 employs eight compartments in one stack and twelve in the other. Since a vending machine consists of one or more coin operated vending stacks held together in a single frame, individual stacks may differ in the number of compartments, each unique by themselves still fitting into the basic frame, making this invention truly modular in concept. The number of coins required for operation with its associated coin holders 64, plunger block 62, receiver block 70, etc., may vary with the application, however, in the preferred embodiment five individual mechanisms are applied. The coin holders 64 may be easily removed individually and replaced with other denominations in any combination, changing price of the commodity is easily accomplished, as only the holders 64 need be changed.

The shelfs 26 are removable allowing a product to share two compartments with one door increasing the flexability of the apparatus. As the stacks are single or in multiples, they are easily adapted to existing housings, either floor or wall mounted and may be configured to many current state of the art cabinets or housings.

In operation a coin 74, or the required multiple thereof, is placed in the coin holder radiused slot 64. The plunger block 62 is manually urged into the body 20 aligning the top edge of the coin 74 with the tapered face of the stack adapter 60. The coin holder 64 is then forced against the resilient compression fork 68 applying upward pressure maintaining an exact alignment of all holders regardless of the diameter of the coin, as each denomination has the same dimensional orientation from the combined coin and slot to the bottom of the holder. The forked end of the holders 64, when precisely aligned with the openings in the receiver block 70, are allowed to pass freely into the slots. The forked end of the coin holder 64 interfaces with the spring stem of the slack eliminator 48 forcing it rearward against pressure from the spring 50 allowing the stack 32 to drop for door opening and the catch 52 to fall into place. The plunger block 62 must be retracted from its fully depressed position for door 42 operation. This is accomplished by the plunger block 62 interceding the roller carriage 36 maintaining its position. As the plunger block 62 is then in the outward position when the door 42 is closed, no further manipulation of any other door is allowed.

Figure 10:
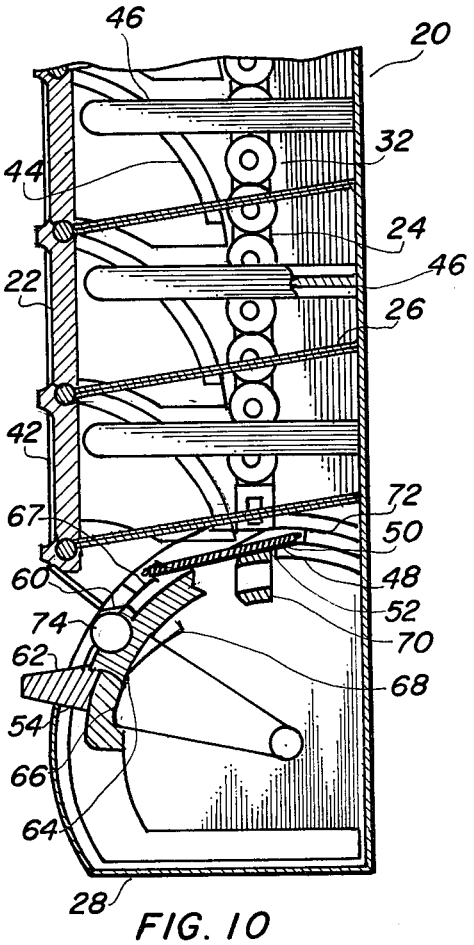
FIG. 10 is another embodiment taken along lines 10—10 of FIG. 1.
Figure 11:
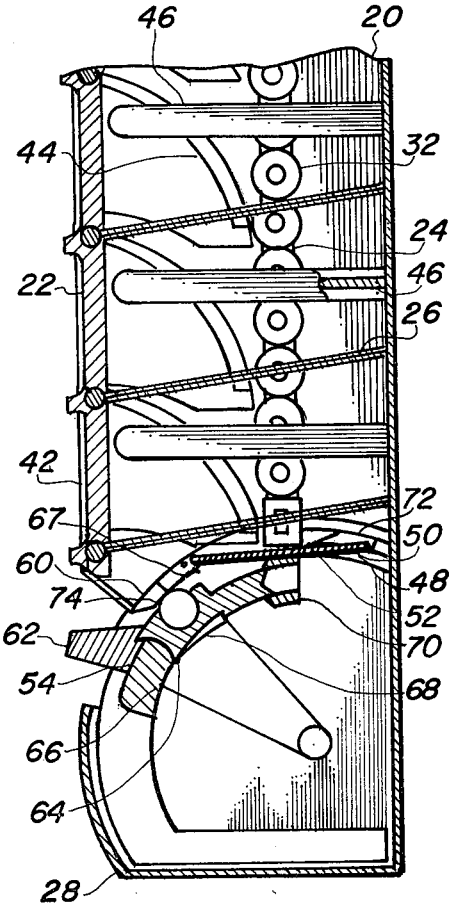
FIG. 11 is another embodiment taken along lines 11—11 of FIG. 1.

In another embodiment, best illustrated in FIGS. 10 and 11, all of the same components ae utilized in their same relationship, except the coin carriage is conformed radially having the carriage 54 distended below the body 20 instead of extending at right angles, as in the preferred embodiment. The plunger 62 moves upwardly into the carriage when a coin 74 is inserted therein. This axial rotation allows the overall depth of the apparatus to be decreased with only a small portion of the plunger block 62 and housing 28 extending beyond the envelope of the stack. This configuration remains the same in function and description of each corresponding element.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A coin operated vending stack having a series of goods compartments arranged in columns comprising:

a. a stack body having door attaching means and a plurality of roller grooves;

b. a plurality of roller piles within said roller grooves for access to a single compartment upon spreading individual rollers thereapart;

c. a plurality of doors having spreader attaching means with two bottom sides rotatably interfacing with said body door attaching means for entrance therethrough upon pivotal rotation, each door juxtapositioned vertically in columnar fashion;

d. a plurality of spreaders having an integral tapered raised projection on one end and the other end rotatably mounted to said door for linear reciprocation upon opening, forcing said tapered projection between said roller pile;

e. a spring loaded slack eliminator having a tapered bearing surface slideably affixed within said stack body with the tapered surface beneath said roller pile while held under the influence of a spring eliminating slack in the pile when contiguous thereto and allowing sufficient movement of the pile for said spreader tapered projection to penetrate said roller pile when said tapered surface is forced thereinto;

f. a catch having a notch on one end and attachment means on the other slideably affixed within said stack body said notch urgingly interfacing with said slack eliminator linearly driving said tapered surface from direct alignment with said roller pile; and, g. a coin carriage disposed within said stack body and connected with said catch attachment means for linear movement when appropriate coins are placed therein driving said slack eliminator away from said roller piles a fixed distance, allowing only one door to be opened, thereby penetrating said roller pile with said spreader providing access to said goods compartment with said slack eliminator returning to alignment with said roller pile under the influence of said spring when said door is closed and said spreader retracted.

2. The apparatus as recited in claim 1 wherein said stack body further comprises:

a. a frame having a plurality of dividers juxtapositioned in planar relationship defining compartments;

b. a pair of sides connected to said frame enclosing said compartments; and, c. a stack adapter joined to the bottom of said stack body for receiving said coin carriage providing alignment thereof.

3. The invention according to claim 1 wherein said roller pile further comprises:

a. a plurality of circular rollers having a hole centrally located therein;

b. a plurality of rectangular roller carriages having a centrally located bore therein and a pair of opposed beveled sides; and, c. a plurality of round tubular axles having a flange on one end disposed within said hole in said roller and said bore of said carriage of a diameter somewhat smaller than said hole allowing rotation of the roller when assembled into a pile sequentially on top of each other.

4. The apparatus as in claim 1 wherein said door attaching means further comprises: said body frame having a pair of circular sockets integral with said sides and said doors having radial projections somewhat smaller in diameter allowing axial movement when in concert therewith.

5. The invention as recited in claim 1 wherein said coin carriage further comprises:

a. a plurality of bifurcated plunger blocks having a plurality of cavities therein and internal teeth in the fork end;

b. a plurality of coin holders having a raised radial projection on one end and a V-shaped notch on the other with a two sided radiused slot in the middle being rotatably disposed within the confines of said plunger block cavities on the projection end being free to move vertically therein;

c. a plurality of lower resilient compression forks having a plurality of tines on one end and a flange on the other fixedly disposed onto said stack body with said flange intimately embracing said body for attachment thereto;

d. a plurality of upper compression forks attached to said stack body having a plurality of tines extending from said attachment juxtapositioned with said coin holders providing linear pressure therefrom;

e. a plurality of plunger forks having a plurality of spaces therethrough corresponding to said plurality of coin holders in said plunger block providing linear containment and enclosure of said radiused slot creating a cavity with two parallel sides and a radiused bottom while allowing vertical movement therein, when said holders are distended within said plunger block forks; and, f. a plurality of receiver blocks having opposed pawls and a plurality of slots of a size and orientation allowing said coin holders to pass freely when precisely aligned and positioned within said stack body and an angular face on top and bottom of said slot depending away from the acuminated surface allowing a coin of the proper size to be inserted into said holder and fork cavity with said plunger block being forceably urged into said stack body, the coin interfacing with said body vertically aligning said holder with said slot providing penetration contiguously driving said slack eliminator away from said stack allowing said catch to lock onto said eliminator and said roller stack to be relaxed falling by gravity a predetermined distance with said pawls engaging said plunger block teeth limiting the travel allowing said door to be opened exposing said goods in said compartment.

6. The invention as recited in claim 1 wherein said coin carriage further comprises:

a. a plurality of radial bifurcated plunger blocks having a plurality of cavities therein and internal teeth in the fork end;

b. a plurality of radial coin holders having a raised projection on one end and a U-shaped notch on the other with a two sided slot in the middle being rotatably disposed within the confines of said plunger block cavities on the projection end being free to move axially therein;

c. a plurality of lower resilient compression forks having a plurality of tines on one end and a flange on the other fixedly disposed onto said stack body with said flange intimately embracing said body for attachment thereto;

d. a plurality of upper compression forks attached to said stack body having a plurality of tines extending from said attachment juxtapositioned with said coin holders providing linear pressure therefrom;

e. a plurality of plunger forks having a plurality of spaces therethrough corresponding to said plurality of coin holders in said plunger block providing linear containment and enclosure of said radiused slot creating a cavity with two parallel sides and a radiused bottom while allowing radial movement therein, when said holders are distended within said plunger block forks; and, f. a plurality of receiver blocks having opposed pawls and a plurality of slots of a size and orientation allowing said coin holders to pass freely when precisely aligned and positioned within said stack body and an angular face on top and bottom of said slot depending away from the acuminated surface allowing a coin of the proper size to be inserted into said holder and fork cavity with said plunger block being radially urged into said stack body, the coin interfacing with said body contiguously aligning said holder with said slot providing penetration driving said slack eliminator away from said stack allowing said catch to lock onto said eliminator and said roller stack to be relaxed falling by gravity a predetermined distance with said pawls engaging said plunger block teeth limiting the travel allowing said door to be opened exposing said goods in said compartment.

7. A coin carriage for vending stacks having a body with doors and an opening mechanism defining goods compartments comprising:

a. a bifurcated plunger block having a plurality of cavities therein and internal teeth in the fork end;

b. a coin holder having a raised radial projection on one end and a V-shaped notch on the other with a two-sided radiused slot in the middle being rotatably disposed within the confines of said plunger block cavities on the projection end being free to move vertically therein;

c. a resilient compression fork having a plurality of tines on one end and a flange on the other fixably disposed onto said body with said flange intimately embracing said body for attachment thereto;

d. a plunger fork having a plurality of spaces therethrough corresponding to said plurality of coin holders in said plunger block providing linear containment and enclosure of said radiused slot creating a cavity with two parallel sides and a radiused bottom while allowing vertical movement therein, when positioned within said distended plunger block forks; and, e. a receiver block having opposed pawls and a plurality of slots of a size and orientation allowing said coin holders to pass freely when precisely aligned and positioned within said body and an angular face on top and bottom of said slot depending away from the acuminated surface allowing a coin of the proper size to be inserted into said holder and fork cavity with said plunger block being forceably urged into said body, the coin interfacing with said body vertically aligning said holder with said slot providing penetration linearly driving said opening mechanism into the open position with said pawls engaging said plunger block teeth limiting the travel allowing said door to be opened exposing said goods in said compartment.

* * * * *